US011163244B2

(12) United States Patent
Fitzgerald et al.

(10) Patent No.: US 11,163,244 B2
(45) Date of Patent: Nov. 2, 2021

(54) PRINT MATERIAL TRANSFER MECHANISMS

(71) Applicant: HEWLETT-PACKARD DEVELOPMENT COMPANY, L.P., Spring, TX (US)

(72) Inventors: Sean Daniel Fitzgerald, Boise, ID (US); Jeff Luke, Boise, ID (US); Gabriel McDaniel, Boise, ID (US)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 17/041,854

(22) PCT Filed: May 20, 2018

(86) PCT No.: PCT/US2018/033836

§ 371 (c)(1),
(2) Date: Sep. 25, 2020

(87) PCT Pub. No.: WO2019/226154

PCT Pub. Date: Nov. 28, 2019

(65) Prior Publication Data

US 2021/0026272 A1 Jan. 28, 2021

(51) Int. Cl.
*G03G 15/08* (2006.01)

(52) U.S. Cl.
CPC ..... *G03G 15/0856* (2013.01); *G03G 15/0863* (2013.01); *G03G 15/0879* (2013.01)

(58) Field of Classification Search
CPC ..... G03G 15/0856; G03G 15/0863; G03G 15/0879; G03G 15/0858; G03G 15/086; G03G 15/0862
See application file for complete search history.

(56) References Cited

U.S. PATENT DOCUMENTS

| | | | | |
|---|---|---|---|---|
| 5,003,352 A | | 3/1991 | Duchesne et al. | |
| 5,012,289 A | | 4/1991 | Aldrich et al. | |
| 5,652,947 A | * | 7/1997 | Izumizaki | G03G 15/0879 399/258 |
| 5,802,420 A | * | 9/1998 | Garr | G03G 15/0856 399/27 |
| 7,593,653 B2 | | 9/2009 | Richey et al. | |
| 7,773,890 B2 | | 8/2010 | Chiba et al. | |
| 7,801,469 B2 | | 9/2010 | Uezono | |
| 8,653,773 B2 | | 2/2014 | Brown et al. | |
| 9,152,084 B2 | | 10/2015 | Shiba et al. | |

(Continued)

FOREIGN PATENT DOCUMENTS

JP 6074895 B2 2/2017

*Primary Examiner* — Sandra Brase
(74) *Attorney, Agent, or Firm* — Staas & Halsey, LLP

(57) ABSTRACT

Example implementations relate to an apparatus to transfer a quantity of print material to a printing device through a transfer mechanism. In some examples, the apparatus includes a container including the quantity of print material, a transfer mechanism associated with the container, and a sensor associated with the transfer mechanism. In some examples, the sensor is to communicate to the printing device information about the transfer of the quantity of print material through the dispenser mechanism.

15 Claims, 7 Drawing Sheets

(56) References Cited

U.S. PATENT DOCUMENTS

| | | | | |
|---|---|---|---|---|
| 2004/0062559 | A1* | 4/2004 | Kinoshita | G03G 15/0856 399/27 |
| 2006/0029406 | A1* | 2/2006 | Nagahama | G03G 15/0863 399/27 |
| 2006/0216046 | A1 | 9/2006 | Hatakeyama | |
| 2016/0170327 | A1* | 6/2016 | Saito | G03G 15/0863 399/27 |

* cited by examiner

PRINT MATERIAL TRANSFER MECHANISMS

CROSS REFERENCE TO RELATED APPLICATIONS

This application is a U.S. National Stage Application which claims the benefit under 35 U.S.C. § 371 of International Patent Application No. PCT/US2018/033836 filed on May 22, 2018, the contents of which are incorporated herein by reference.

BACKGROUND

Printing devices, such as printers, scanners, copiers, three-dimensional (3D) printers, etc., may generate text, images, or objects on print media, such as paper, plastic, etc. In some examples, printing devices may perform a print job comprising printing text and/or graphics by transferring print material, such as ink, toner, agents, powders, etc., to print media.

DETAILED DESCRIPTION

Figure 1:
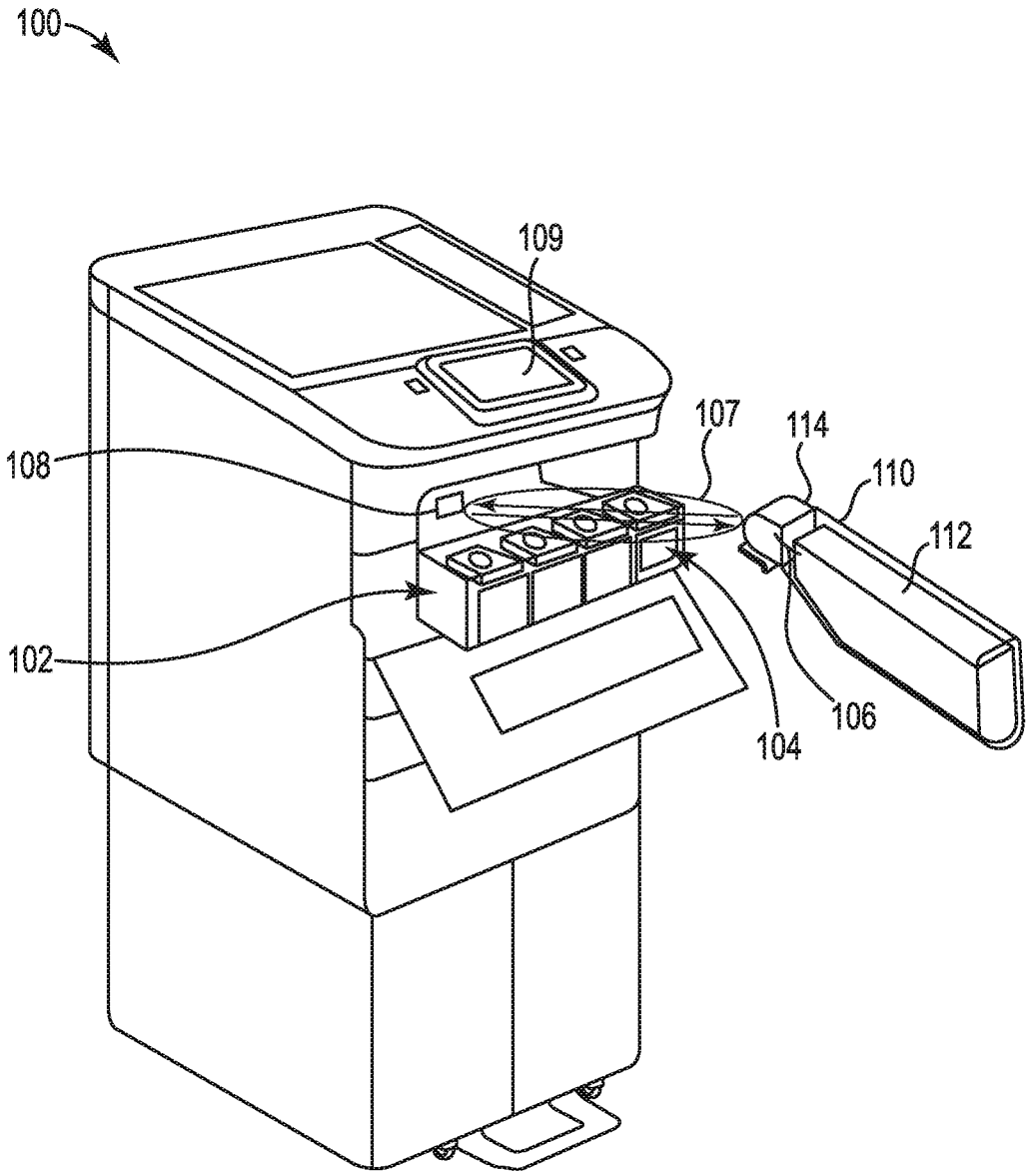
FIG. 1 illustrates a diagram of an example of a printing device according to the disclosure.

As mentioned above, printing devices may apply print material to print media. Examples of printing devices include printers, scanners, copiers, etc. Examples of print material include ink, toner, etc. In addition, in the case of 3D printing, examples of print material include inks, agents, powders, etc. Examples of print media include paper, plastic, a bed of build materials in the case of 3D printing, etc. The printing devices may include a supply to store print material to the printing device for use upon a print medium. As used herein, the term "supply" is intended to mean a storage container or reservoir within the printing device to hold a volume of print material, whether in liquid or solid particle form, for use by the printing device in printing. The supply may have a finite amount of print material disposed within a volume of the supply. As such, the amount of print material in the supply may be reduced during operation of the printing device, for instance, due to application of print material from the supply to the print medium.

At some point, the amount of print material in the supply may be less than a threshold amount of print material for the printing device to operate as intended. Therefore, the supply may need to have a quantity of print material transferred to it so as to refill the supply to include enough print material for the printing device to operate as intended.

Separately, an apparatus including a container to hold print material may be utilized to transfer a quantity of print material to the supply of a printing device as part of a refilling process. A quantity of print material from within a container associated with the apparatus may be transferred through a transfer mechanism associated with the container to a supply associated with a printing device. The transfer mechanism may include a conduit or a passageway capable of coupling the container to an aperture of the supply and be able to pass print material from the container to the supply.

However, transfer of print material to the supply takes time. It may be unclear to an operator when there is not enough print material in the container of the apparatus to refill the supply enough for the printing device to operate as intended. It may also be unclear to an operator when there is not enough print material in the container of the apparatus to refill the supply to a full amount, or whether a supply is already at a full amount and is about to overflow. It may be important to not overfill or underfill a supply and it may be important for the operator to know that an intended amount of print material has been transferred to the supply.

Some approaches attempting to identify when a supply is sufficiently filled (e.g., above a threshold amount) and/or full have employed weight-based approaches such as those that weigh a supply and based on the weight, estimate whether the supply is full. However, such approaches may be costly, inaccurate, and/or may not provide other information such as determination of the quantity of print material transferred, and the remainder of print material within the container.

As such, examples described herein are directed to transfer mechanisms such as those included in a printing device and/or included in an apparatus used to provide print material to a printing device. For example, a printing device may include a supply to store print material for use, a transfer mechanism associated with the supply to receive a quantity of print material from a container associated with an apparatus and coupled to the printing device to refill and/or resupply the printing device with print material. A sensor may be associated with the transfer mechanism to detect the transfer of the quantity of print material from the container to the supply.

An apparatus used to provide print material to a printing device may be attachable to the printing device, and may include a container to hold print material, a transfer mechanism associated with the container for transfer of the print material to a supply associated with the printing device, and a sensor associated with the transfer mechanism to detect the transfer of the quantity of print material transferred from the container to the supply.

Sensors may detect transfer of print material and electronically communicate information to a controller associated with a printing device to update information the controller has concerning status and operations of the printing device. As used herein, the term "controller" is intended to include application specific integrated circuits (ASICs), field programmable gate arrays (FPGAs), etc., capable of controlling operations of a device, such as a printing device. Based on the information provided by the sensor, the controller may determine a quantity of print material being transferred from the container to the supply, as well as a remainder of print material left within the container.

As a non-limiting example, the transfer mechanism may be cylindrical, at least at some point, and include a component that may be spun, and/or revolved, and/or rotated, etc., by a flow of a quantity of print material. As the print material is transferred through the transfer mechanism, the flow of the quantity of print material may cause a movement (e.g., a spin, a revolution, a rotation, etc.) of the component which may be detected by a sensor and lead to detection of the transfer by the sensor. This movement of a component and detection by a sensor (e.g., a spin, a revolution, a rotation, etc.) may be utilized to determine the quantity of print material being transferred when taken into account with a number of movements caused, for how long, etc.

For example, a quantity of print material transferred through a transfer mechanism may be determined by taking into account a cubic volume of the transfer mechanism, a sensing rate (e.g., spins per minute, revolutions per minute, rotations per minute, etc.) of a component (discussed below in FIGS. 3, 4, 5, and 6), and a time measurement. In this non-limiting example, the cubic volume equals $\pi$ times radius of the transfer mechanism squared times height of the transfer mechanism. Once this volume is calculated, subtract displacement caused by the component included in the transfer mechanism. This results in a volume of a flow through the transfer mechanism and, when taken into account with sensed rotations and a time measurement, allows for a determination of the quantity of print material that is transferred through the transfer mechanism. This quantity also leads to determination of a remainder of print material left within the container when it is known how much was in the container before the transfer.

FIG. 1 illustrates a diagram of an example of a printing device 100 according to the disclosure. The example printing device 100 illustrated in FIG. 1 may be a printing, scanning, copying machine, etc. The printing device 100 may include a supply 102 with print material for use by the printing device 100. As shown in the example, the supply 102 may have an aperture 104 that can receive a resupply apparatus 106. The resupply apparatus 106 can include a container 110 having a quantity of print material 112. A transfer mechanism 114 may be associated with the aperture 104 on the printing device 100 and/or associated with the container 110 on the resupply apparatus 106 to transfer print material to the printing device 100.

The container of print material 110 may transfer the quantity of print material 112 to the supply 102 through the transfer mechanism 114 and the aperture 104. As stated above, print material may include toner, ink, and other particulates of the sort. The quantity of print material 112 transferred through the transfer mechanism 114 and the aperture 104 may be stored in the supply 102 for use by the printing device 100. As a result, the supply 102 may include the quantity of print material 112 received, as well as a previous amount of print material (not shown) that was already within the supply 102.

A sensor (not shown in FIG. 1) associated with the transfer mechanism 114 may detect a flow of a quantity of print material as the quantity of print material 112 is transferred from the resupply apparatus 106 to the supply 102 through the transfer mechanism 114. The sensor may track the transfer of the quantity of print material 112 from the resupply apparatus 106 to the supply 102. The sensor may communicate information about the detected transfer to a controller 108 associated with the printing device 100 via a communication link 107. The communication link 107 for the sensor to communicate with the controller 108 may be a physical connection and/or a wireless connection, e.g., a USB connection, a Bluetooth connection, and/or an NFC connection.

Based on the information the sensor communicates, the controller 108 may determine the quantity of print material 112 transferred to the supply through the transfer mechanism 114. The controller 108 may determine a new amount of print material within the supply 102 based on the quantity of print material 112 transferred to the supply 102 as well as a previous amount of print material already within the supply 102. The controller 108 may determine a status of printable pages based on the determined amount of print material within the supply 102.

The controller 108 may include hardware, such as a processing resource (not shown) and a memory resource (not shown), among other electronics/hardware, as known in the art, to perform functions described herein. For instance, the controller 108 may present the determined amount of print material and/or a status of printable pages based on the determined amount of print material on a display 109 associated with the printing device 100. The controller 108 may restrict the transfer of the quantity of print material 112 upon determination of the supply 102 having reached a predetermined amount of print material. The controller 108 or the transfer mechanism 114 may restrict transfer of the print material 112 due to receipt of an input.

Figure 2:
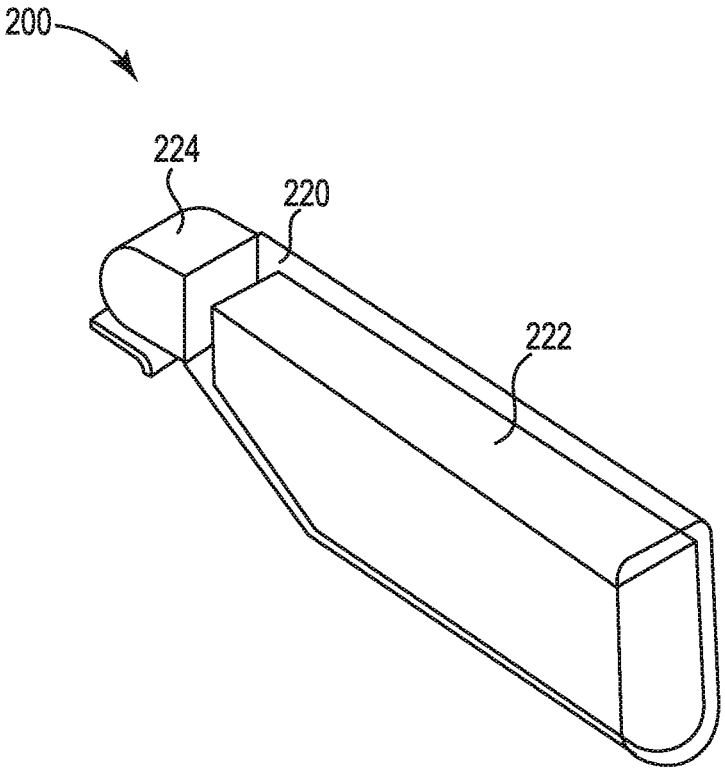
FIG. 2 illustrates a diagram of an example of an apparatus according to the disclosure.

FIG. 2 illustrates a diagram of an example of an apparatus 200 according to the disclosure. The apparatus 200, e.g., resupply apparatus, may be attachable to a variety of printing devices, including the ones mentioned above. The apparatus 200 may include a container 220 that includes print material 222. The print material 222 may be transferred to a printing device (shown as 100 in FIG. 1) through a transfer mechanism 224 associated with the printing device and/or associated with the container 220 of the apparatus 200. In the example of FIG. 2, the transfer mechanism 224 is associated with the container 22 of the apparatus 200. The transfer mechanism 224 may transfer a quantity of print material 222 to a supply (shown as 102 in FIG. 1) associated with the printing device. In some examples, transfer of the quantity of print material 222 through the transfer mechanism 224 may be detected by a sensor (not shown in FIG. 2) associated with the transfer mechanism 224.

For example, a sensor (not shown in FIG. 2) associated with the transfer mechanism 224 can detect movement of a part, e.g., a blade, a wheel, etc., of a component (discussed below in FIGS. 3, 4, 5, and 6) associated with the transfer mechanism 224 during the transfer of print material 222. The sensor can communicate information associated with the transfer to the printing device to determine a quantity of print material 222 being transferred. A communication link (shown as 107 in FIG. 1) for the sensor to communicate information with the printing device may be a physical connection and/or a wireless connection, e.g., a USB connection, a Bluetooth connection, and/or an NFC connection.

The printing device can update the quantity of print material 222 transferred to a supply (shown as 102 in FIG. 1) associated with the printing device. The printing device can update a new amount of print material within the supply, wherein the new amount of print material includes the quantity of print material transferred as well as a previous amount of print material already within the supply. In some examples, the printing device can present the new amount of print material within the supply and/or a status of printable pages based on the new amount of print material within the supply on a display (shown as 109 in FIG. 1) associated with the printing device. In some examples, the printing device can also present on the display a remainder of print material left within the container 220.

Figure 3:
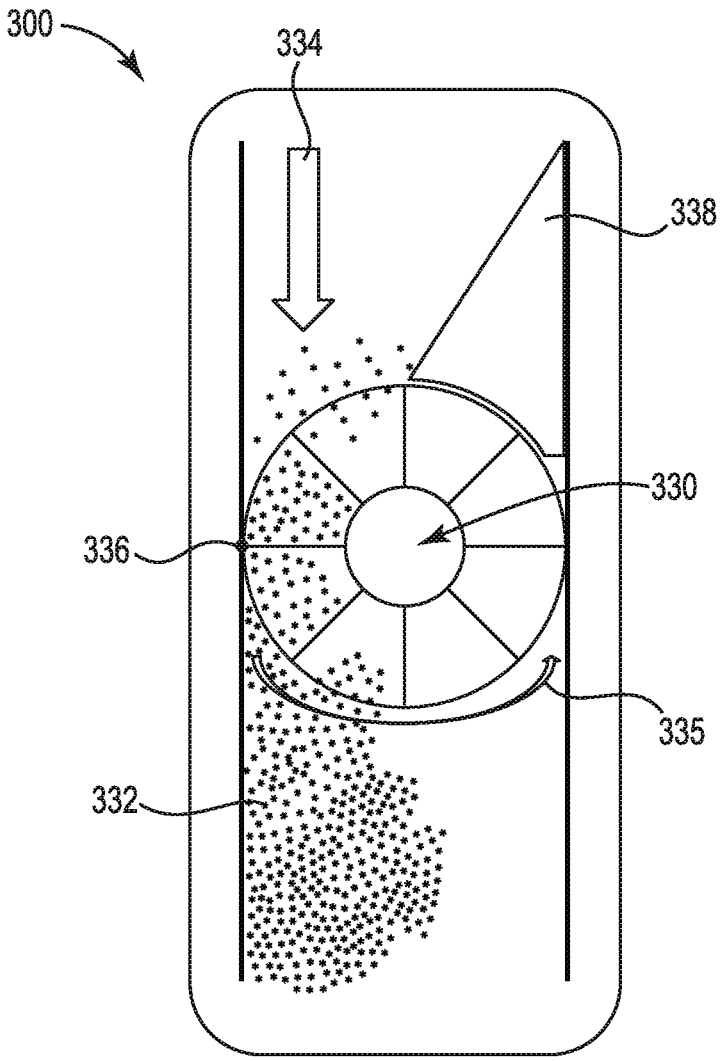
FIG. 3 illustrates a diagram of an example of a transfer mechanism including a sectioned wheel according to the disclosure.

FIG. 3 illustrates a diagram of an example of a transfer mechanism 300 including a sectioned wheel 330 according to the disclosure. For example, the sectioned wheel 330 may be one component to the transfer mechanism 300. A ramp 338 may be another component to the transfer mechanism 300 and may cause print material 332 to flow in a particular direction 334, thereby causing rotation 335 of the sectioned wheel 330. In some examples, the transfer mechanism 300 may be associated with a sensor 336. The rotation 335 of the sectioned wheel 330 may be detected by the sensor 336. Information about the rotation 335 may be communicated by the sensor 336 to a controller (shown as 108 in FIG. 1) associated with a printing device (shown as 100 in FIG. 1) via a communication link (shown as 107 in FIG. 1).

For example, when rotation, indicated by arrow 335 of a sectioned wheel 330 of the transfer mechanism 300 is detected by a sensor 336, information about the rotation 335 is communicated to a controller (shown as 108 in FIG. 1) associated with a printing device (shown as 100 in FIG. 1). The rotation 335 is caused by a flow of a quantity of print material 332 being transferred through the dispenser mechanism 300. Based on information about the rotation 335, the quantity of print material 332 being transferred may be determined by the controller.

Figure 4B:
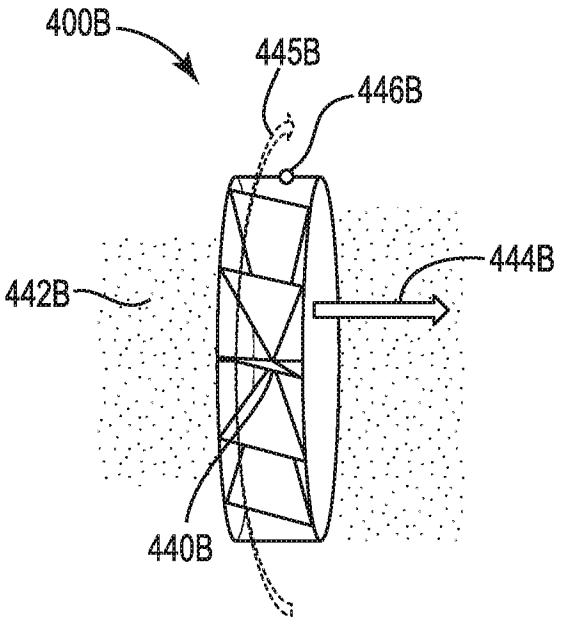
FIGS. 4A and 4B respectively illustrate from different viewpoints diagrams of examples of a transfer mechanism including a turbine according to the disclosure.
Figure 4A:
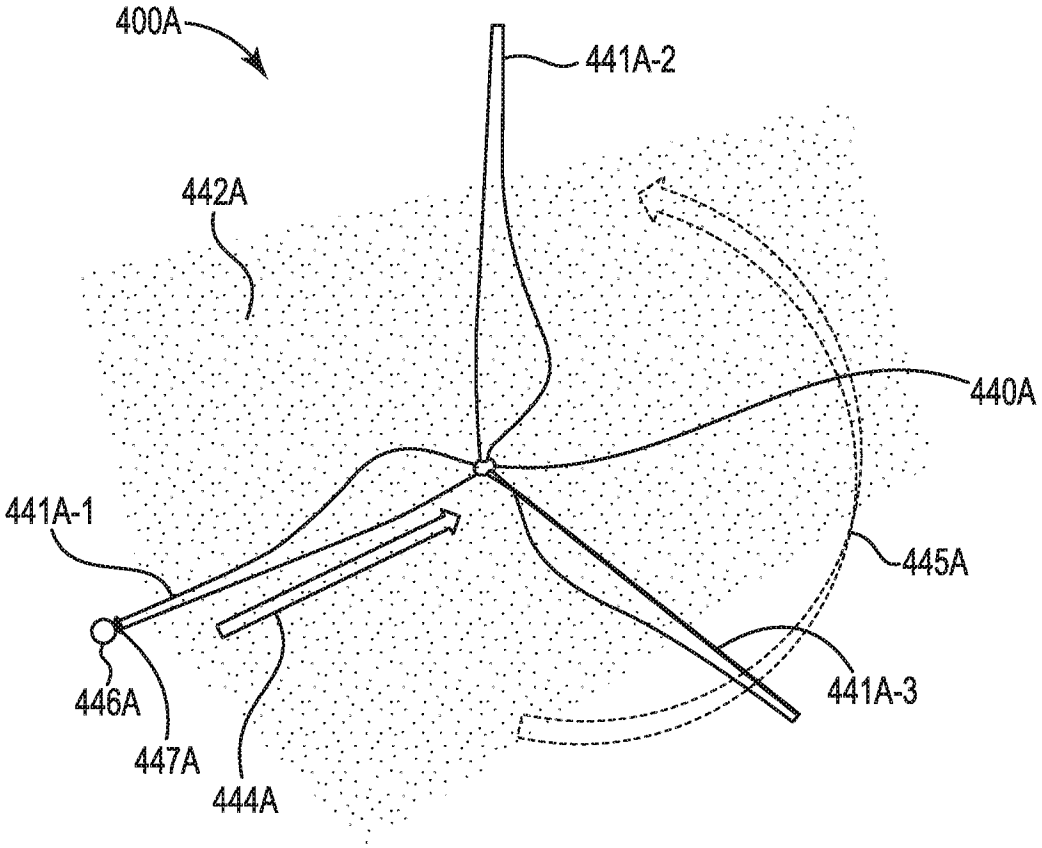

FIGS. 4A and 4B respectively illustrate from different viewpoints diagrams of examples of a transfer mechanism 400A and 400B including a turbine 440A and 440B according to the disclosure. In this example, the turbine 440A and 440B is a component to the transfer mechanism 400A and 400B. Print material 442A and 442B passing through the transfer mechanism 400A and 400B in a particular direction, indicated by arrows 444A and 444B, causes a spin 445A and 445B of the turbine 440A and 440B. As shown in FIGS. 4A and 4B, the turbine 440A and 440B is caused to spin 445A and 445B on an axis due to angled features that create resistance to a substance flowing across their surface. As shown in FIG. 4A, as blades 441A-1, 441A-2, and 441A-3 of the turbine 440A spin, electricity may be generated through magnetic attraction caused by a magnet 447A serving as a sensor 446A in the turbine 440A Electric poles generated by the magnetic attraction may be used to count rotations of the blades 441A-1, 441A-2, and 441A-3. This sensed information can be communicated from the dispenser mechanism 400 to a controller (shown as 108 in FIG. 1) of a printing device (shown as 100 in FIG. 1) to calculate a quantity of print material as described above. Although FIG. 4A only illustrates one sensor 446A and one magnet 447A on one turbine blade 441A-1 in FIG. 4A, a number of sensors, magnets, and locations may be included in examples of the present description.

In this manner, the transfer mechanism 400A and 400B may be associated with sensors 446A and 446B. The spin 445A and 445B of the turbine 440A and 440B may be detected by the sensors 446A and 446B. The spin 445A and 445B of the turbine 440A and 440B may be detected by the sensors 446A and 446B. The sensors 446A and 446B may communicate information about the spin 445A and 445B to a controller (shown as 108 in FIG. 1) associated with a printing device (shown as 100 in FIG. 1). The information may be communicated via a communication link (shown as 107 in FIG. 1). The controller may determine a quantity of print material 442A and 442B being transferred through the transfer mechanism 400A and 400B based on the information communicated to the controller by the sensors 446A and 446B.

For example, when a spin 445A and 445B of a turbine 440A and 440B is detected by a sensor 446A and 446B, information about the spin 445A and 445B is communicated to a controller (shown as 108 in FIG. 1) associated with a printing device (shown as 100 in FIG. 1). The spin 445A and 445B may be caused by a flow of a quantity of print material 442A and 442B in a particular direction 444A and 444B. The controller may determine the quantity of print material 442A and 442B transferred based on the information communicated to the controller by the sensor 446A and 446B.

Figure 5B:
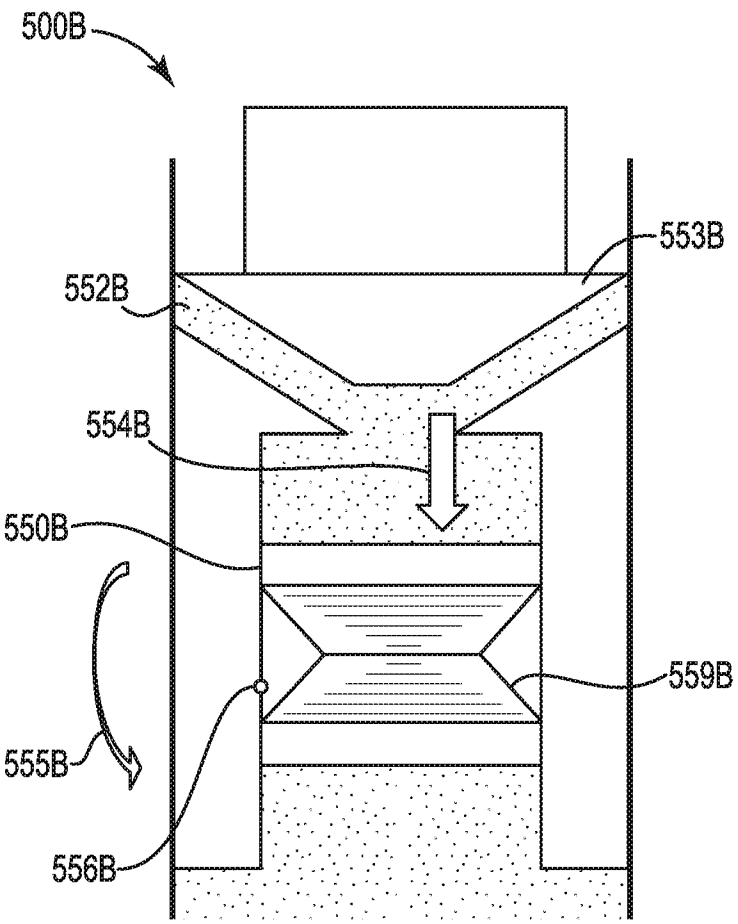
FIGS. 5A and 5B respectively illustrate from different viewpoints diagrams of examples of a transfer mechanism including a fitted rotor according to the disclosure.
Figure 5A:
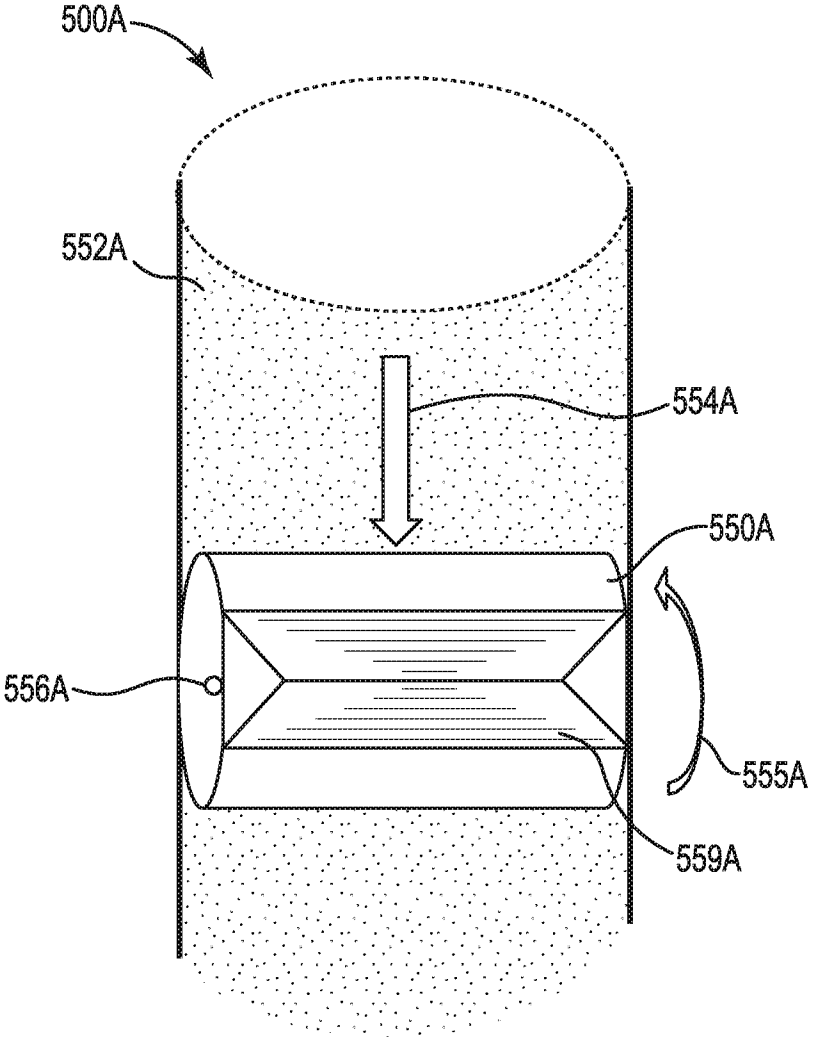

FIGS. 5A and 5B respectively illustrate from different viewpoints diagrams of examples of a transfer mechanism 500A and 500B including a fitted rotor 550A and 550B according to the disclosure. In this example, the fitted rotor 550A and 550B is a component to the transfer mechanism 500A and 500B. Print material 552A and 552B passing through the transfer mechanism 500A and 500B in a particular direction, indicated by arrows 554A and 554B, causes a rotation 555A and 555B of the fitted rotor 550A and 550B. The fitted rotor 550A and 550B may include an open cavity 559A and 559B angled to facilitate rotation 555A and 555B. As shown in FIG. 5B, a plunger 553B may apply force to the print material 552B and cause the print material 552B to flow in the particular direction 554B causing the rotation 555B.

The transfer mechanism 500A and 500B may be associated with a sensor, e.g., 556A and 556B, respectively. The sensor 556A and 556B may include sensors of the type described herein. Alternatively, sensors may be in the form of magnets, etc., and/or equivalents thereof. The rotation 555A and 555B of the rotor 550A and 550B may be detected by the sensor 556A and 556B. Information about the rotation 555A and 555B may be communicated by the sensor 556A and 556B to a controller (shown as 108 in FIG. 1) associated with a printing device (shown as 100 in FIG. 1). The information may be communicated through a communication link (shown as 107 in FIG. 1), The controller may determine a quantity of print material 552A and 552B being transferred through the transfer mechanism 500A and 500B based on the information communicated by the sensor 556A and 556B to the controller.

For example, when rotation 555A and 555B of a fitted rotor 550A and 550B is detected by a sensor 556A and 556B, information about the rotation 555A and 555B is communicated to a controller (shown as 108 in FIG. 1) associated with a printing device (shown as 100 in FIG. 1). The rotation 555A and 555B may be caused by a flow of a quantity of print material 552A and 552B in a particular direction 554A and 554B. The controller may determine the quantity of print material 552A and 552B transferred based on the information communicated to the controller by the sensor 556A and 556B.

Figure 6B:
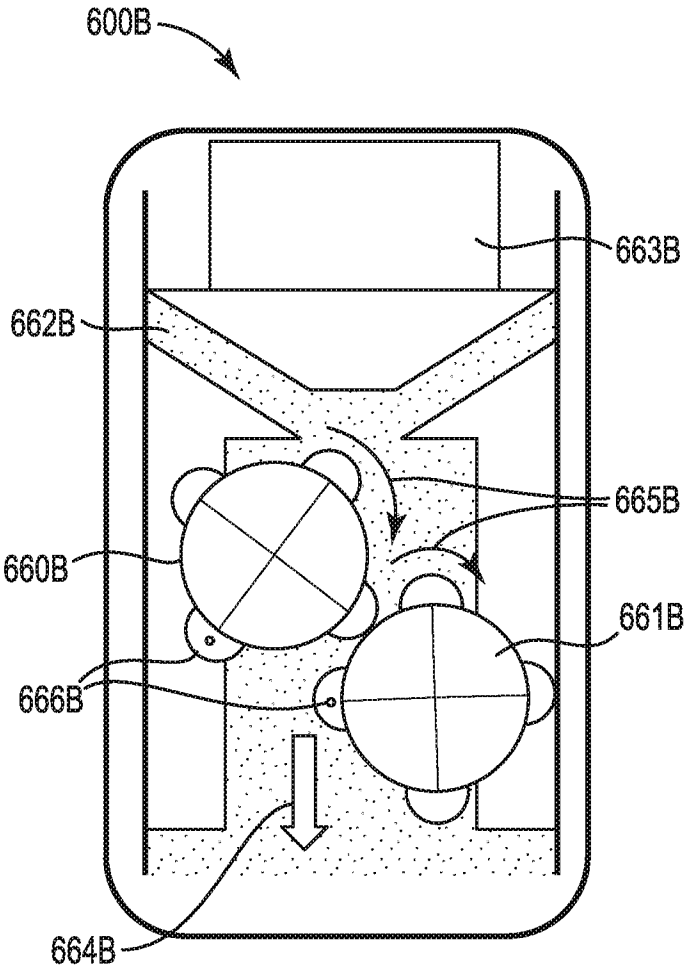
FIGS. 6A and 6B respectively illustrate from different viewpoints diagrams of examples of a transfer mechanism including geometric gears according to the disclosure.
Figure 6A:
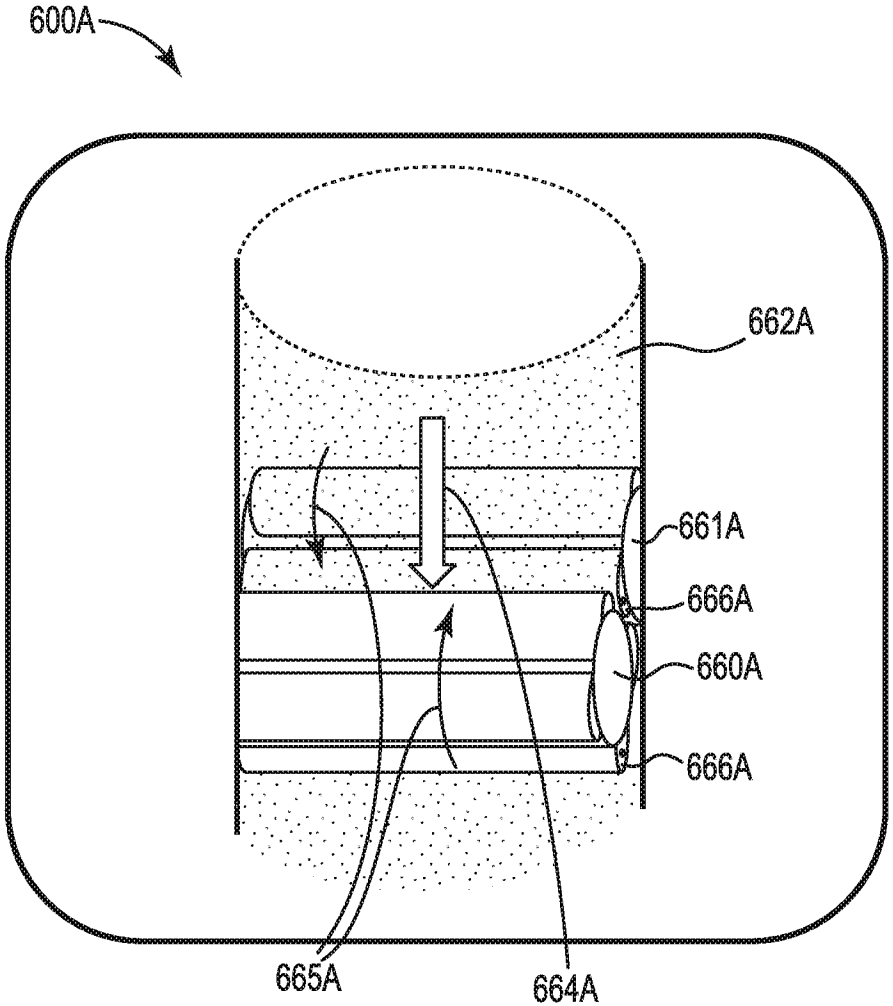

FIGS. 6A and 6B respectively illustrate from different viewpoints diagrams of examples of a transfer mechanism 600A and 600B including geometric gears 660A, 660B, 661A, and 661B according to the disclosure. The transfer mechanism shown in FIGS. 3, 4, 5, and 6 may be associated with the apparatus shown in FIG. 2, or in some examples, may be associated with the supply (shown as 102 in FIG. 1) of the printing device shown in FIG. 1. In this example, the geometric gears 660A and 660B are a component to the transfer mechanism 600A and 600B. As shown in FIGS. 6A and 6B, the transfer mechanism 600A and 600B may include a first geometric gear 660A and 660B and a second geometric gear 661A and 661B. The first geometric gear 660A and 660E and second geometric gear 661A and 661B may be on a shaft with synchronized splines (not shown) to facilitate revolutions 665A and 665B of the geometric gears 660A, 660B, 661A, and 661B. Print material 662A and 662B passing through the transfer mechanism 600A and 600B in a particular direction, indicated by arrows 664A and 664B, causes revolutions 665A and 665B of the geometric gears 660A, 660B, 661A, and 661B. Examples herein are not limited to the number of geometric gears shown. As shown in FIG. 6B, a plunger 663B may apply force to the print material 662B and cause the print material 662B to flow in the particular direction 664B causing the revolutions 666B.

The transfer mechanism 600A and 600B may be associated with sensors 666A and 666B as the same have been described herein. The revolutions 665A and 665B may be detected by the sensors 666A and 666B. Information about the revolutions 665A and 665B may be communicated by the sensors 666A and 666B to a controller (shown as 108 in FIG. 1) associated with a printing device (shown as 100 in FIG. 1). The information may be communicated through a communication link (shown as 107 in FIG. 1). The controller may determine a quantity of print material 662A and 662B being transferred through the transfer mechanism 600A and 600B based on the information communicated by the sensors 666A and 666B to the controller.

For example, when revolutions 665A and 665B of geometric gears 660A, 660B, 661A, and 661B are detected by sensors 666A and 666B, information about the revolutions 665A and 665B is communicated to a controller (shown as 108 in FIG. 1) associated with a printing device (shown as 100 in FIG. 1). The revolutions 665A and 665B may be caused by a flow of a quantity of print material 662A and 662B in a particular direction 664A and 664B. The controller may determine the quantity of print material 662A and 662B transferred based on the information communicated to the controller by the sensors 666A and 666B.

Figure 7B:
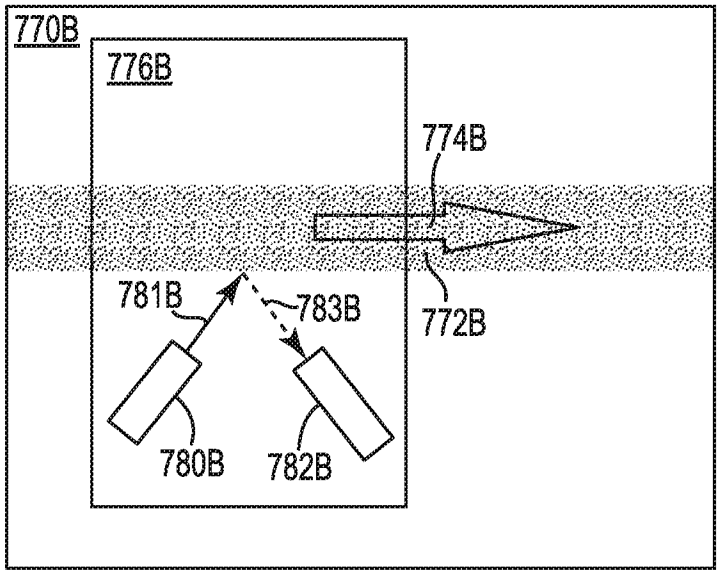
FIG. 7B illustrates a diagram of an example of a reflective density sensor associated with a transfer mechanism.
Figure 7A:
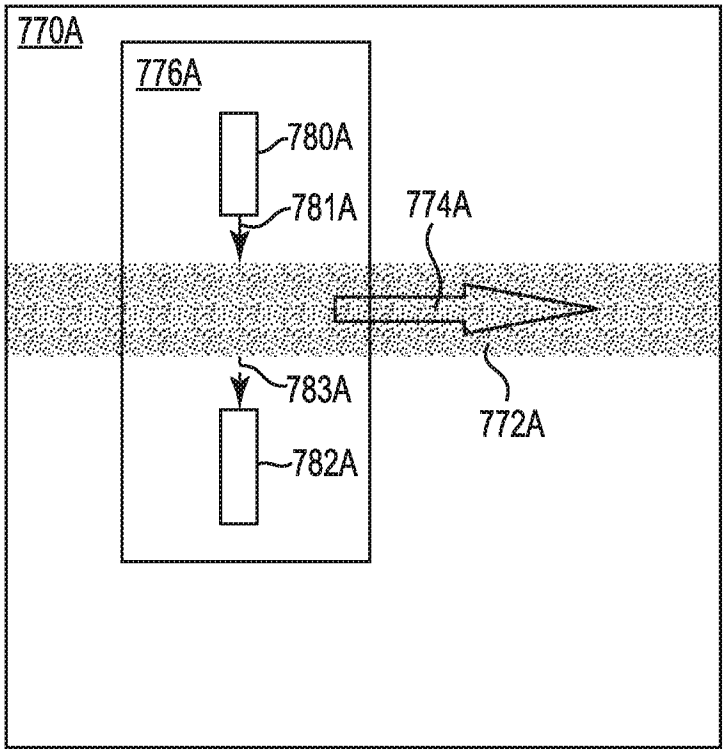
FIG. 7A illustrates a diagram of an example of a transmissive density sensor associated with a transfer mechanism.

FIG. 7A illustrates a diagram of an example of a transmissive density sensor 776A associated with a transfer mechanism 770A. The transmissive density sensor 776A illustrated in FIG. 7A is intended to serve as a non-limiting example of sensors shown in FIGS. 3, 4, 5, and 6. For example, as shown in FIG. 7A, as a quantity of print material 772A flows in a particular direction 774A through the transfer mechanism 770A, the transmissive density sensor 776A is to detect and gain information about the quantity of print material 772A being transferred. In this example, the transmissive density sensor 776A is to include an emitter 780A that emits a light 781A that passes through the quantity of print material 772A. On the opposite side of the emitter 780A is a detector 782A that receives the light 781A after the light 781A passes through the quantity of print material 772A. A signal strength change 783A of the light 781A caused by the light 781A passing through the quantity of print material 772A is a function of a density of the quantity of print material 772A. The transmissive density sensor 776A communicates information about the signal strength change 783A to a controller (shown as 108 in FIG. 1) associated with a printing device (shown as 100 in FIG. 1). Based on the information provided by the transmissive density sensor 776A and other details listed above (radius, height, etc.), the controller determines the quantity of print material 772A being transferred through the transfer mechanism 770A.

FIG. 7B illustrates a diagram of an example of a reflective density sensor 776B associated with a transfer mechanism 770B. The reflective density sensor 776B illustrated in FIG. 7B is intended to serve as a non-limiting example of sensors shown in FIGS. 3, 4, 5, and 6. Furthermore, as an example, a transmissive density sensor (shown as 776A in FIG. 7A) and the reflective density sensor 776B may be used independently, or in conjunction.

In the example shown in FIG. 7B, as a quantity of print material 772B flows in a particular direction 774B through the transfer mechanism 770B, the reflective density sensor 776B is to detect and gain information about the quantity of print material 772B being transferred. In this example, the reflective density sensor 776B is to include an emitter 780B that emits a light 781A that reflects off the quantity of print material 772B. On the same side as the emitter 780B is a detector 782B that receives the light 781B as the light 781B reflects from the quantity of print material 772B. A signal strength change 783B of the light 781B caused by the light 78BA reflecting off the quantity of print material 772B is a function of a density of the print material 772B. The reflective density sensor 776B communicates information about the signal strength change 783B to a controller (shown as 108 in FIG. 1) associated with a printing device (shown as 100 in FIG. 1). Based on the information provided by the reflective density sensor 776B and other details listed above (radius, height, etc.), the controller determines the quantity of print material 772B being transferred through the transfer mechanism 770B. In both FIGS. 7A and 7B, the use of light is not intended to be limiting. For example, instead of light, a laser could be used.

In the foregoing detailed description of the present disclosure, reference is made to the accompanying drawings that form a part hereof, and in which is shown by way of illustration how examples of the disclosure may be practiced. These examples are described in sufficient detail to enable those of ordinary skill in the art to practice the examples of this disclosure, and it is to be understood that other examples may be utilized and that process, electrical, and/or structural changes may be made without departing from the scope of the present disclosure.

In addition, elements shown in the various figures herein can be added, exchanged, and/or eliminated so as to provide a number of additional examples of the present disclosure. For example, a number of sensors within a component included in a transfer mechanism may be greater than or lesser than as illustrated in the example figures. The proportion and the relative scale of the elements provided in the figures are intended to illustrate the examples of the present disclosure and should not be taken in a limiting sense.

What is claimed:

1. An apparatus comprising:

a container including print material;

a transfer mechanism associated with the container to transfer a quantity of print material from the container to a printing device attachable to the apparatus; and a sensor associated with the transfer mechanism to detect transfer of the quantity of print material from the container to the printing device and to communicate to the printing device information about the transfer of the quantity of print material, the information including a density of the quantity of print material being transferred.

2. The apparatus of claim 1, wherein the sensor is to communicate to the printing device information about the transfer of the quantity of print material via a wireless communication link between the apparatus and the printing device.

3. The apparatus of claim 2, wherein, based on the communication of information about the transfer to the printing device and information of a previous amount of print material already within the printing device, a controller of the printing device is to update information associated with a new amount of print material in a supply of the printing device.

4. The apparatus of claim 1, wherein the transfer mechanism includes a turbine that is caused to spin on an axis due to angled features that create resistance to a substance flowing across their surface, and the sensor is to communicate a number of spins of the turbine during the transfer of print material to the printing device.

5. The apparatus of claim 1, wherein the transfer mechanism includes a sectioned wheel, and the sensor is to communicate a rotation of the sectioned wheel during the transfer of print material to the printing device.

6. The apparatus of claim 1, wherein the transfer mechanism includes a fitted rotor, and the sensor is to communicate a rotation of the fitted rotor during the transfer of print material to the printing device.

7. The apparatus of claim 1, wherein the transfer mechanism includes geometric gears on a shaft with synchronized splines, and the sensor is to communicate a number of revolutions of the geometric gears during the transfer of print material to the printing device.

8. A printing device comprising:

a supply to store print material;

a transfer mechanism associated with the supply to receive a quantity of print material from an attachable container; and a sensor associated with the transfer mechanism to detect transfer of the quantity of print material from the container to the printing device and to communicate information about the transfer to a controller associated with the printing device, the information including a density of the quantity of print material being transferred.

9. The printing device of claim 8, wherein the controller is to determine a new amount of print material in the supply based on the quantity of print material transferred to the supply and a previous amount of print material already within the supply.

10. The printing device of claim 9, wherein the transfer mechanism is to restrict transfer of the quantity of print material to the supply when the controller determines the amount of print material has reached a predetermined amount.

11. The printing device of claim 8, wherein the controller is to update a status of printable pages based on the amount of print material in the supply.

12. A system comprising:

a container including:

print material;

a transfer mechanism to transfer a quantity of the print material; and a sensor associated with the transfer mechanism, wherein the sensor detects transfer of the quantity of print material based on a density of the print material being transferred; and a supply associated with a printing device attachable to the container, wherein the supply is to receive the quantity of print material through the transfer mechanism, and wherein the supply is to store a new amount of print material including the quantity of print material transferred by the container and a previous amount of print material already within the supply.

13. The system of claim 12, wherein the transfer mechanism is to restrict transfer of the quantity of print material to the supply upon receipt of an input.

14. The system of claim 12, wherein a controller associated with the printing device is to update the printing device when the print material reaches a predetermined level within the supply.

15. The system of claim 14, wherein the controller is to determine a remainder of print material within the container and update the printing device with the remainder of print material.

* * * * *